US010362823B1

(12) United States Patent
Hill et al.

(10) Patent No.: US 10,362,823 B1
(45) Date of Patent: Jul. 30, 2019

(54) EYELASH EXTENSION CASE

(71) Applicant: Jessica Hill, Philadelphia, PA (US)

(72) Inventors: Jessica Hill, Washougal, WA (US); Adrian Cotirla, Hillside, IL (US); Joseph Grasso, Warwick, IL (US); Joseph MacMillan, III, Portland, OR (US)

(73) Assignee: Jessica Hill, Philadelphia, PA (US)

( * ) Notice: Subject to any disclaimer, the term of this patent is extended or adjusted under 35 U.S.C. 154(b) by 123 days.

(21) Appl. No.: 15/250,866

(22) Filed: Aug. 29, 2016

Related U.S. Application Data

(60) Provisional application No. 62/211,038, filed on Aug. 28, 2015.

(51) Int. Cl.

| | |
|---|---|
| ***A41G 5/02*** | (2006.01) |
| ***B65D 25/10*** | (2006.01) |
| ***B65D 85/00*** | (2006.01) |
| ***B65D 25/54*** | (2006.01) |
| ***B65D 43/16*** | (2006.01) |

(52) U.S. Cl.
CPC ..... *A41G 5/02* (2013.01); *B65D 25/10* (2013.01); *B65D 25/54* (2013.01); *B65D 43/16* (2013.01); *B65D 85/70* (2013.01); *A45D 2200/05* (2013.01)

(58) Field of Classification Search
CPC ..... A41G 5/02; A45D 2200/05
USPC ..... 132/216
See application file for complete search history.

(56) References Cited

U.S. PATENT DOCUMENTS 3,315,689 A * 4/1967 Melik ..... A41G 5/02 132/317
3,333,593 A * 8/1967 McGivern ..... A41G 5/02 132/217
3,491,775 A * 1/1970 Aylott ..... A41G 5/02 132/216
3,504,682 A * 4/1970 Aylott ..... A41G 5/02 132/216
3,516,423 A * 6/1970 Seidler ..... A41G 5/02 132/216
3,517,673 A * 6/1970 Charles ..... A41G 5/02 132/214
3,557,653 A * 1/1971 Kim ..... A41G 5/02 132/56

(Continued)

FOREIGN PATENT DOCUMENTS

GB 1069798 A * 5/1967 ..... A41G 5/02

*Primary Examiner* — Ruth Ilan
(74) *Attorney, Agent, or Firm* — Alleman Hall Creasman & Tuttle LLP

(57) ABSTRACT

An eyelash extension case includes an enclosure body defining an internal region for storage of one or more eyelash extensions, and a lid operative to cover the internal region in a closed state and open to allow access to the internal region in an open state. Internal wall surfaces of the internal region form a floor, and one or more eyelash extension retaining features. Each eyelash extension retaining feature includes a protrusion that extends outward from the floor toward the lid along an axis. Each protrusion has curved wall surfaces that transition into the floor, and each protrusion further has curved wall surfaces that define an outer profile of the protrusion surrounding the axis. At least a portion of each protrusion is formed from a self-adhesive super-gel material that is relatively sticky to retain one or more eyelash extensions.

13 Claims, 4 Drawing Sheets

(56) References Cited

U.S. PATENT DOCUMENTS

| | | | | |
|---|---|---|---|---|
| 3,645,281 | A * | 2/1972 | Seidler | A41G 5/02 132/216 |
| D640,834 | S * | 6/2011 | Chen | D28/83 |
| 8,701,685 | B2 * | 4/2014 | Chipman | A45D 44/00 132/201 |
| 8,881,741 | B1 * | 11/2014 | Mattson | A41G 5/02 132/201 |
| 9,044,077 | B1 * | 6/2015 | Lin | A45D 44/00 |
| D823,544 | S * | 7/2018 | Nguyen | D28/83 |
| 2014/0110304 | A1 * | 4/2014 | Wu | B65D 25/54 206/776 |
| 2018/0065779 | A1 * | 3/2018 | Chiba | B65D 25/10 |

* cited by examiner

EYELASH EXTENSION CASE

CROSS-REFERENCE TO RELATED APPLICATIONS

The present application is a non-provisional application that claims priority to and the benefit of U.S. provisional patent application Ser. No. 62/211,038, titled EYELASH EXTENSION CASE, filed Aug. 28, 2015, the contents of which are incorporated herein by reference in their entirety for all purposes.

BACKGROUND

Eyelash extensions may be worn by people to increase the appearance of eyelash length or fullness, or to otherwise visually augment the appearance of a person's eyelashes.

SUMMARY

An eyelash extension case includes an enclosure body defining an internal region for storage of one or more eyelash extensions, and a lid operative to cover the internal region in a closed state and open to allow access to the internal region in an open state. Internal wall surfaces of the internal region form a floor, and one or more eyelash extension retaining features. Each eyelash extension retaining feature includes a protrusion that extends outward from the floor toward the lid along an axis. Each protrusion has curved wall surfaces that transition into the floor, and each protrusion further has curved wall surfaces that define an outer profile of the protrusion surrounding the axis. At least a portion of each protrusion is formed from an a self-adhesive super-gel material to retain one or more eyelash extensions.

It will be appreciated that the above summary describes only some of the concepts covered in greater detail in the following detailed description. As such, claimed subject matter is not limited to the contents of this summary.

DETAILED DESCRIPTION

Figure 8:
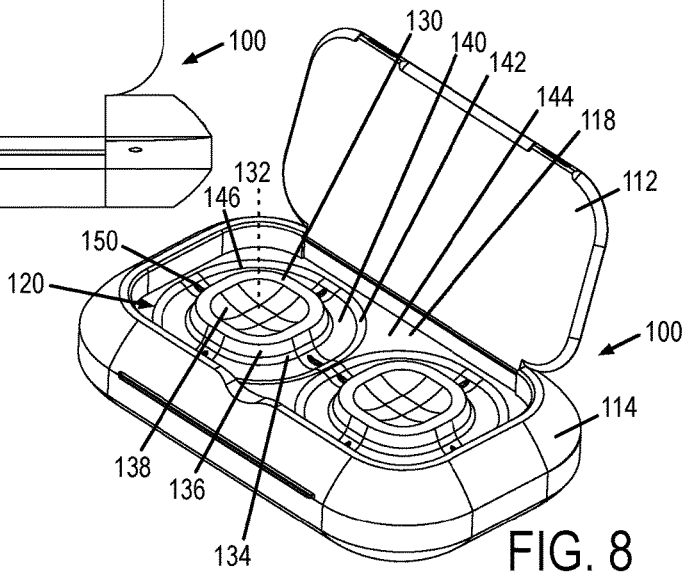
Figure 9:
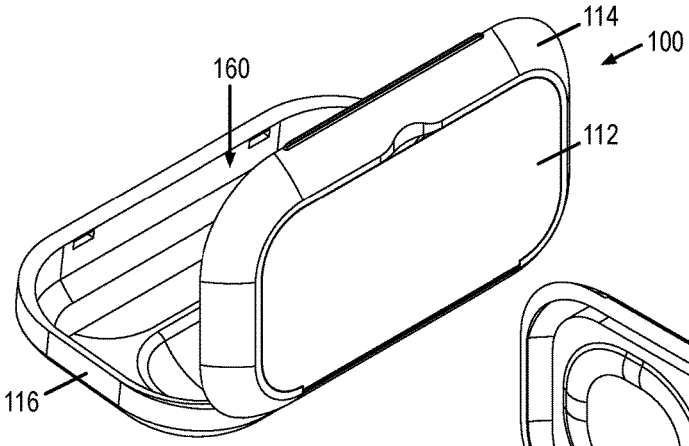
FIGS. 9-12 depict the example eyelash extension case of FIGS. 1-8 with enclosure body halves opened relative to each other to reveal additional internal aspects of the eyelash extension case.
Figure 10:
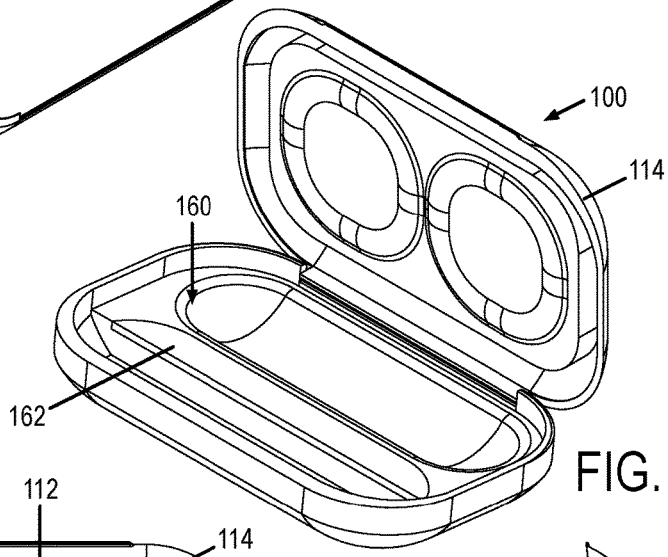
Figure 11:
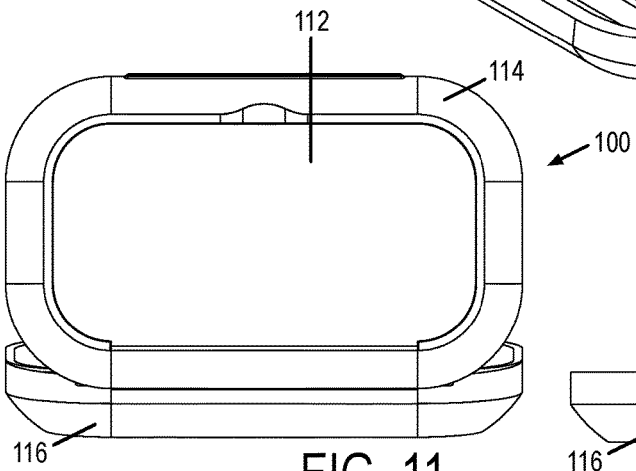
Figure 12:
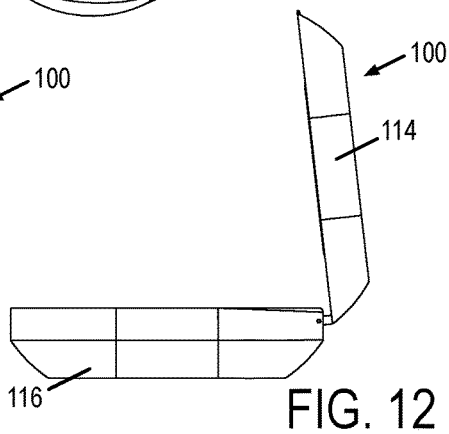

FIGS. 1-4 depict an example eyelash extension case 100. Case 100 includes an enclosure body 110 that defines an internal region 111 (depicted in FIGS. 5 and 8) for storage of one or more eyelash extensions. Case 100 further includes a lid 112 that is operative to cover internal region 111 in a closed state and open to allow access to the internal region in an open state. In an example, lid 112 and enclosure body 110 are hinged together. Lid 112 may be clear in at least some examples to enable viewing of contents stored within internal region 111.

Enclosure body 110 may be formed from two enclosure body halves 114, 116 that collectively define another internal region 160 (depicted in FIGS. 9 and 10) for storage of tools, adhesives, or other implements associated with eyelash extensions. In an example, the two enclosure body halves 114, 116 are hinged together. FIGS. 9-12 depict the example eyelash extension case 100 with enclosure body halves 114, 116 opened relative to each other to reveal additional internal aspects of the eyelash extension case.

FIGS. 5-8 depict the example eyelash extension case 100 with lid 112 opened to reveal internal aspects of internal region 111 of the eyelash extension case. Enclosure body half 114 include internal wall surfaces of the internal region that form a floor 118, and one or more eyelash extension retaining features. In this example, the internal wall surfaces of the internal region includes two eyelash extension retaining features 120, 122.

Figure 5:
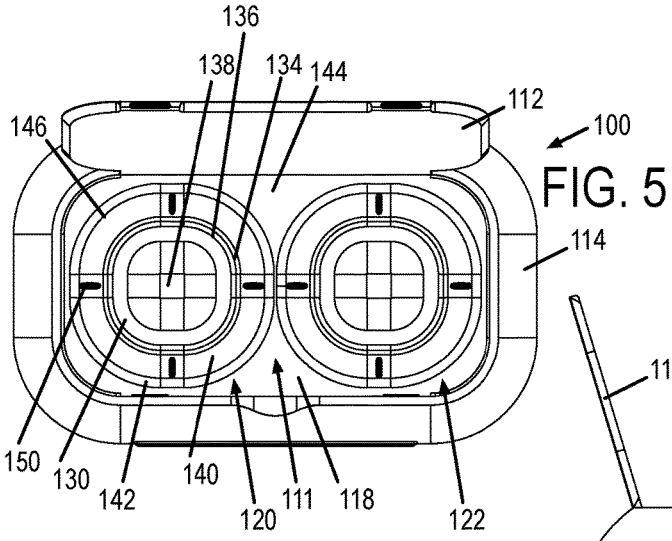
FIGS. 5-8 depict the example eyelash extension case of FIGS. 1-4 with a lid opened to reveal internal aspects of the eyelash extension case.
Figure 6:
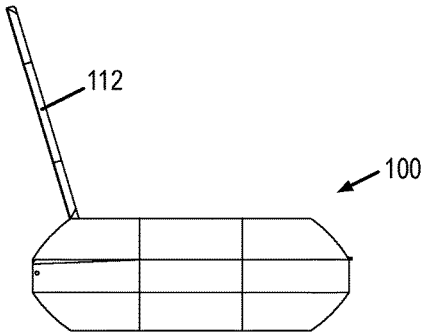
Figure 7:
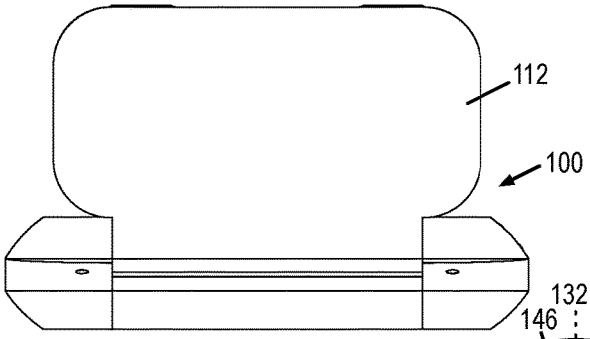

Each eyelash extension retaining feature includes a protrusion 130 that extends outward from the floor 118 toward lid 112 along an axis 132. Each protrusion has curved wall surfaces 134 that transition into floor 118, and each protrusion has curved wall surfaces 136 that define an outer profile of the protrusion surrounding axis 132. The outer profile of each protrusion may define a circle, an ellipse, a square-like shape having substantially rounded corners (e.g., as depicted in FIG. 5), a rectangle-like shape having substantially rounded corners, or other suitable wrapped volume/solid.

Each protrusion may be surrounded by a depressed region 140 of the floor 118. Curved wall surfaces 134 that transition into floor 118 may transition into depressed region 140 of the floor. Each depressed region may include curved wall surfaces 142 that transition to a raised region 144 of floor 118 surrounding the depressed region, and each depressed region may have curved wall surfaces 146 that define an outer profile of the depressed region surrounding axis 132. In at least some examples, the each protrusion (and in some examples the floor region thereof) may be formed from a unitary piece of material that is retained by surrounding material of either the floor region or the raised region in the case that the protrusion and floor region are integrated into a common piece of material Depressed region 140 may be omitted in some examples.

Each protrusion is typically sized to accommodate one or more eyelash extensions (e.g., for a typical human) along the curved wall surfaces 134 that transition into the floor, and the curved wall surfaces 136 that define the outer profile of the protrusion. This complex curve in two different planes (e.g., curved wall surfaces 136 are wrapped about axis 132, and curved wall surfaces are wrapped about an axis that is perpendicular to axis 132 in a given plane) accommodates the complex shape of a three-dimensional eyelash extension. In an example, each protrusion and its associated curved wall surfaces are sized to accommodate four eyelash extensions in which each eyelash extension surrounds approximately one-quarter of the outer profile of the protrusion. In at least some examples, each protrusion and/or each depressed region of the floor surrounding the protrusion may include a set of visual indicators 150 that radially define eyelash extension storage regions (e.g., four regions) of the protrusion. These visual indicators may surround corner regions (having curved corners) of the protrusion to mark a location where an eyelash extension is to be placed between the indicators and onto the corner region of the protrusion.

In at least some examples, a terminal end of each protrusion contacts the lid in the closed state. In at least some examples, each protrusion includes a rim defining a terminal end of the protrusion surrounding a depressed region 138 of the protrusion. Depressed region 138 of the protrusion may have curved wall surfaces that define a bowl or tray within which smaller eyelash extension components (e.g., individual eye lash hairs or groups) may be stored. In examples where the rim contacts the lid, the bowl in combination with the lid forms a seal that retains smaller components within the bowl.

At least a portion of each protrusion may be formed from a self-adhesive super-gel material (i.e., "super gel") that is relatively sticky to retain one or more eyelash extensions. In an example, the elastomeric material is or includes polyurethane or silicone, or a combination thereof, among other suitable materials. This self-adhesive super-gel material typically includes an elastomer or has elastomeric properties, and maintains an adhesive surface indefinitely or for a relatively long time as compared to a traditional glue adhesive having an intentionally short setting time. This self-adhesive super-gel material enables eyelash extensions to be placed onto the material to be retained during storage, and later removed over many cycles without damaging the eyelash extensions. In other words, the self-adhesive material is reusable over many cycles and over extended periods of time. The adhesive properties of the super-gel material reduces movement of the eyelash extensions within the case (e.g., even if an orientation of the case changes or the case is jostled), thereby reducing damage caused to the eyelash extensions during transport. It will be understood that other suitable materials having permanent or semi-permanent surface adhesive properties may be used that enable eyelash extensions to be retained and safely removed over multiple cycles without damaging the eyelash extensions.

In an example, each protrusion is formed from the self-adhesive super-gel material between the terminal end of the protrusion and a base of the protrusion before transitioning to a hard plastic or other suitable non-adhesive material that forms the floor. In another example, each protrusion is formed from the self-adhesive super-gel material between the terminal end of the protrusion and a beginning of a transition into the floor. In yet another example, each protrusion and portions of the floor (e.g., the depressed region) may be formed from the self-adhesive super-gel material. Surfaces within internal region 160 may be formed from the self-adhesive super-gel material, such as example surface 162 depicted in FIG. 10. In still further examples, each protrusion may be formed from an elastomeric material whereas the surrounding portions of the case are formed from a rigid material, such as a rigid plastic.

Figure 1:
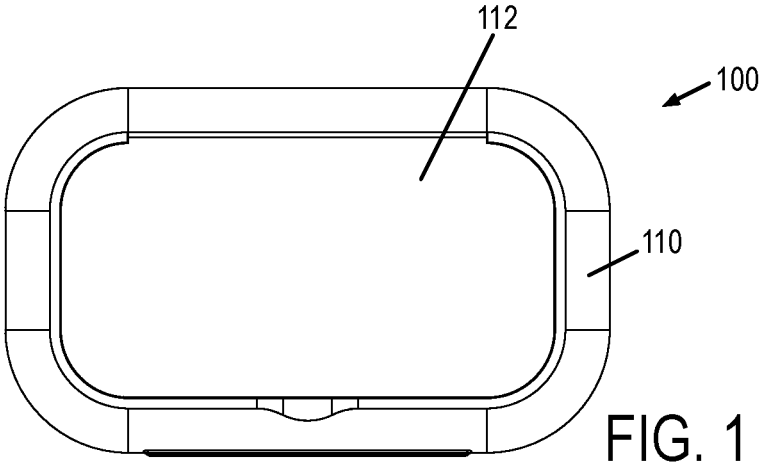
FIGS. 1-4 depict an example eyelash extension case.
Figure 2:
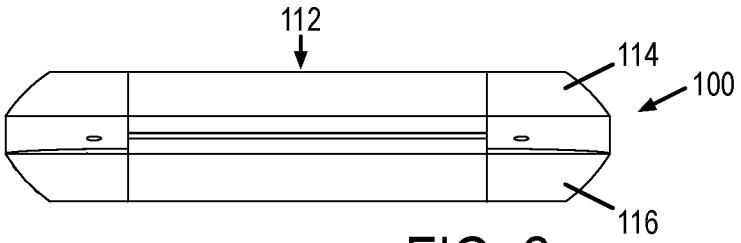
Figure 3:
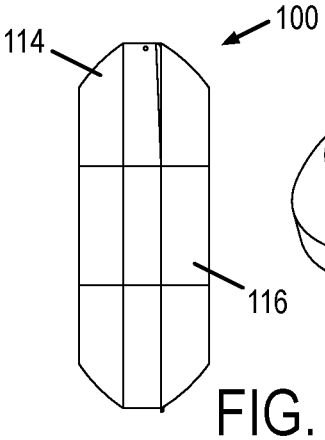
Figure 4:
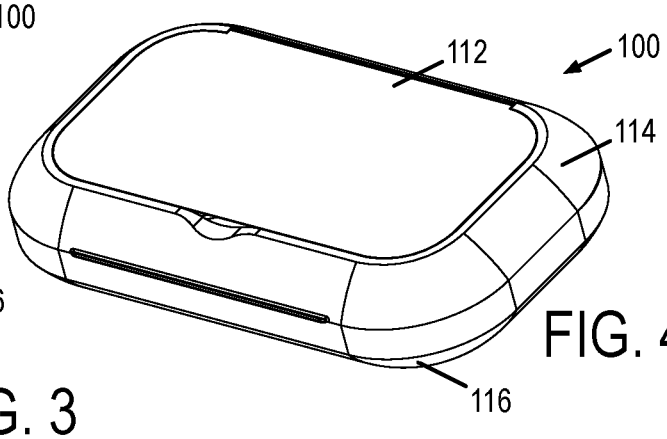
Figure 13:
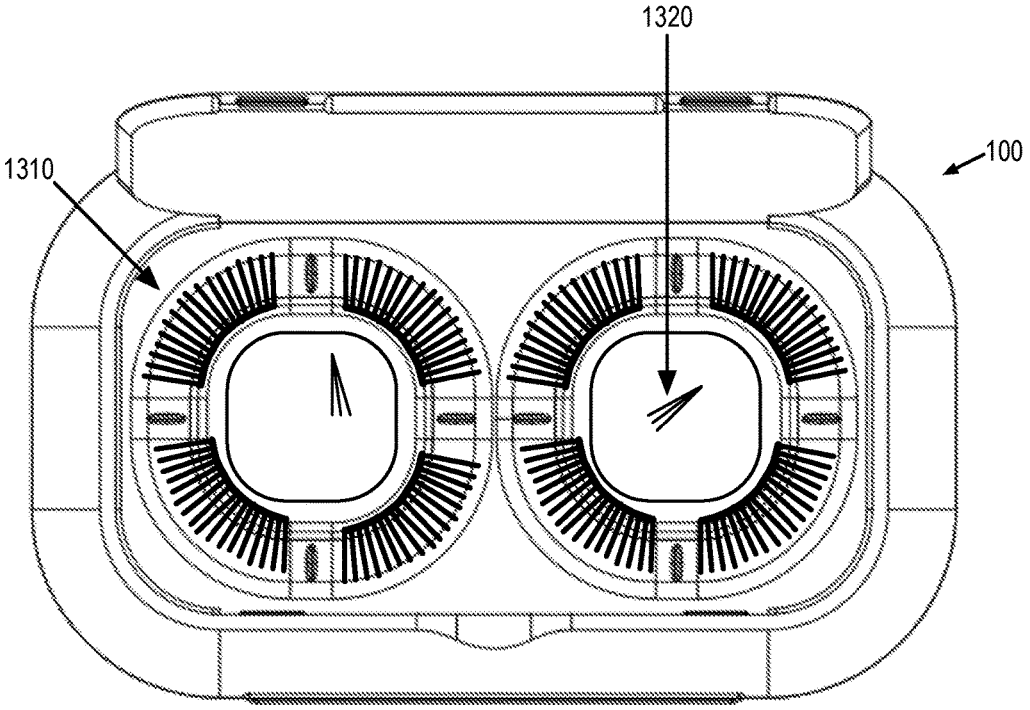
FIG. 13 depicts an example of an eyelash extension case in which eyelash extensions are adhered to and retained by the self-adhesive super-gel material.

FIG. 13 depicts the example eyelash extension case 100 of FIG. 1 in which eyelash extensions 1310 are adhered to and retained by the self-adhesive material (e.g., super gel), and eyelash extension portions 1320 are retained within a bowl formed at the top of the protrusions. In this example, a base of the eyelash extensions are adhered to the protrusions, and the eyelashes curve with the curved wall surfaces of the protrusion and floor. The curvature of these wall surfaces may help retain a curved shape of the eyelash extensions during transport and storage. Here, each protrusion of case 100 is depicted holding four eyelash extensions. In an example, such as depicted in FIG. 13, a relative size and/or diameter/width of each protrusion may be sized to accommodate an individual eyelash extension of a typical adult size at quarter-rotation increments about the protrusion. In at least some scenarios, a quarter-round of each protrusion provides a curved surface that approximates the curvature of the eyelash extension for a typical adult eyelid.

In accordance with an aspect of the present disclosure, in an example, an eyelash extension case includes an enclosure body defining an internal region for storage of one or more eyelash extensions; and a lid operative to cover the internal region in a closed state and open to allow access to the internal region in an open state. In this example or any other example described herein, internal wall surfaces of the internal region form a floor, and one or more eyelash extension retaining features. In this example or any other example described herein, each eyelash extension retaining feature includes a protrusion that extends outward from the floor toward the lid along an axis. In this example or any other example described herein, each protrusion has a curved wall surfaces that transition into the floor. In this example or any other example described herein, each protrusion has curved wall surfaces that define an outer profile of the protrusion surrounding the axis. In this example or any other example described herein, at least a portion of each protrusion is formed from a self-adhesive super-gel material to retain the one or more eyelash extensions. In this example or any other example described herein, each protrusion is surrounded by a depressed region of the floor. In this example or any other example described herein, the curved wall surfaces that transition into the floor transition into the depressed region of the floor. In this example or any other example described herein, each depressed region includes curved wall surfaces that transition to a raised region of the floor surrounding the depressed region, each depressed region having curved wall surfaces that define an outer profile of the depressed region surrounding the axis. In this example or any other example described herein, a terminal end of each protrusion contacts the lid in the closed state. In this example or any other example described herein, the internal wall surfaces of the internal region includes two eyelash extension retaining features. In this example or any other example described herein, the outer profile of each protrusion defines a circle, an ellipse, a square-like shape having substantially rounded corners, or a rectangle-like shape having substantially rounded corners. These substantially rounded corners (or alternatively non-rounded right angled corners or slightly rounded corners) may delineate storage regions of the eyelash extensions in at least some examples. In this example or any other example described herein, each protrusion includes a rim defining a terminal end of the protrusion surrounding a depressed region of the protrusion. In this example or any other example described herein, the depressed region of the protrusion has curved wall surfaces that define a bowl. In this example or any other example described herein, each protrusion is sized to accommodate one or more eyelash extensions along the curved wall surfaces that transition into the floor, and the curved wall surfaces that define the outer profile of the protrusion. In this example or any other example described herein, each protrusion is sized to accommodate four eyelash extensions in which each eyelash extension surrounds approximately one-quarter of the outer profile of the protrusion. In this example or any other example described herein, each protrusion and/or each depressed region of the floor surrounding the protrusion includes a set of visual indicators (e.g., four visual indicators) that radially define four eyelash extension storage regions of the protrusion. In this example or any other example described herein, the lid is formed from a clear material (e.g., a clear plastic or glass). In this example or any other example described herein, the enclosure body is formed from two enclosure body halves that collectively define a second internal region. In this example or any other example described herein, the two enclosure body halves are hinged together. In this example or any other example described herein, the lid is hinged to the enclosure body.

It should be understood that the disclosed examples are illustrative and not restrictive. Variations to the disclosed examples that fall within the metes and bounds of the claims or equivalence of such metes and bounds are intended to be embraced by the claims.

The invention claimed is:

1. An eyelash extension case, comprising:

an enclosure body defining a first internal region for storage of one or more eyelash extensions; and a lid operative to cover the first internal region in a closed state and open to allow access to the first internal region in an open state;

wherein internal wall surfaces of the first internal region form a floor, and one or more eyelash extension retaining features, each eyelash extension retaining feature including a protrusion that extends outward from the floor toward the lid along an axis, each protrusion having curved wall surfaces that transition into the floor, and each protrusion having curved wall surfaces that define an outer profile of the protrusion surrounding the axis, and wherein at least a portion of each protrusion is formed from a self-adhesive super-gel material to retain the one or more eyelash extensions wherein the enclosure body is formed from two enclosure body halves that collectively define a second internal region.

2. The eyelash extension case of claim 1, wherein each protrusion is surrounded by a depressed region of the floor, and the curved wall surfaces that transition into the floor transition into the depressed region of the floor; and wherein each depressed region includes curved wall surfaces that transition to a raised region of the floor surrounding the depressed region, each depressed region having curved wall surfaces that define an outer profile of the depressed region surrounding the axis.

3. The eyelash extension case of claim 2, wherein each protrusion and/or each depressed region of the floor surrounding the protrusion includes a set of visual indicators that radially define four eyelash extension storage regions of the protrusion.

4. The eyelash extension case of claim 1, wherein a terminal end of each protrusion contacts the lid in the closed state.

5. The eyelash extension case of claim 1, wherein the internal wall surfaces of the first internal region includes two eyelash extension retaining features.

6. The eyelash extension case of claim 1, wherein the outer profile of each protrusion defines a circle, an ellipse, a square-like shape having substantially rounded corners, or a rectangle-like shape having substantially rounded corners.

7. The eyelash extension case of claim 1, wherein each protrusion includes a rim defining a terminal end of the protrusion surrounding a depressed region of the protrusion.

8. The eyelash extension case of claim 7, wherein the depressed region of the protrusion has curved wall surfaces that define a bowl.

9. The eyelash extension case of claim 1, wherein each protrusion is sized to accommodate one or more eyelash extensions along the curved wall surfaces that transition into the floor, and the curved wall surfaces that define the outer profile of the protrusion.

10. The eyelash extension case of claim 9, wherein each protrusion is sized to accommodate four eyelash extensions in which each eyelash extension surrounds approximately one-quarter of the outer profile of the protrusion.

11. The eyelash extension case of claim 1, wherein the lid is clear.

12. The eyelash extension case of claim 1, wherein the two enclosure body halves are hinged together.

13. The eyelash extension case of claim 1, wherein the lid is hinged to the enclosure body.

* * * * *